US006370874B1

(12) United States Patent
Rausch et al.

(10) Patent No.: US 6,370,874 B1
(45) Date of Patent: Apr. 16, 2002

(54) HYDRAULIC CONTROL DEVICE FOR A MOBILE MACHINE, ESPECIALLY FOR A WHEEL LOADER

(75) Inventors: Georg Rausch, Lohr/Main; Dieter Roth, Schlüchtern, both of (DE)

(73) Assignee: Mannesmann Rexroth AG, Lohr/Main (DE)

( * ) Notice: Subject to any disclaimer, the term of this patent is extended or adjusted under 35 U.S.C. 154(b) by 0 days.

(21) Appl. No.: 09/485,451

(22) PCT Filed: Aug. 4, 1998

(86) PCT No.: PCT/EP98/04848

§ 371 Date: Feb. 10, 2000

§ 102(e) Date: Feb. 10, 2000

(87) PCT Pub. No.: WO99/07950

PCT Pub. Date: Feb. 18, 1999

(30) Foreign Application Priority Data

Aug. 11, 1997 (DE) ..... 197 34 658

(51) Int. Cl.[7] ..... F16D 31/02
(52) U.S. Cl. ..... 60/413; 60/417
(58) Field of Search ..... 60/413, 417, 469; 91/420, 445

(56) References Cited

U.S. PATENT DOCUMENTS

| | | | | |
|---|---|---|---|---|
| 4,286,432 A | * | 9/1981 | Burrows et al. | 91/420 |
| 4,951,767 A | | 8/1990 | Keagbine | |
| 5,034,892 A | | 7/1991 | Saotome | 60/413 |
| 5,449,194 A | | 9/1995 | Wernimont et al. | |
| 5,477,677 A | | 12/1995 | Krnavek | 60/414 |
| 5,802,847 A | * | 9/1998 | Harnischfeger | 60/413 |

FOREIGN PATENT DOCUMENTS

| | | |
|---|---|---|
| DE | 3239930 | 5/1984 |
| DE | 3909205 | 5/1990 |
| DE | 68918930 | 8/1990 |
| DE | 4129509 | 3/1993 |
| DE | 4221943 | 3/1993 |
| DE | 4212184 | 10/1993 |
| EP | 0349067 | 1/1990 |

OTHER PUBLICATIONS

Patent Abstracts of Japan vol. 016, No. 374 (M–1293) Aug. 11, 1992–& JP 04 120323 A (Komatsu Ltd), Apr. 21, 1992.

Patent Abstracts of Japan vol. 017, No. 569 (M–1496), Oct. 15, 1993–& JP 05 163745 A ((Komatsu Ltd), Jun. 29, 1993.

Patent Abstracts of Japan vol. 095, No. 001, Feb.28, 1995 – & JP 06 280287 A (Komatsu Mec Corp;Others: OI) Oct. 4, 1994.

Patent Abstracts of Japan vol. 010, No. 122 (M–476), May 7, 1986 –& JP 60 250128 A (Mitsubishi Jukogyo KK), Dec. 10, 1985.

* cited by examiner

*Primary Examiner*—Edward K. Look
*Assistant Examiner*—Thomas E. Lazo
(74) *Attorney, Agent, or Firm*—Martin A. Farber

(57) ABSTRACT

A hydraulic control arrangement for a mobile working machine has at least one hydraulic cylinder with the aid of which a working tool is moved, a directional control valve for controlling pressure-fluid channels between chambers of the hydraulic cylinder, a pressure-fluid source and a tank, a hydraulic accumulator connected to the pressure-fluid source via a filling line, and a control valve to open and to close a connection between the hydraulic accumulator and a pressure chamber of the hydraulic cylinder. To achieve a damping of pitching movement of the machine, a pilot-operated shutoff valve is connected upstream of the pressure chamber of the hydraulic cylinder, and opens when the directional control valve is actuated to allow pressure fluid to flow off from the pressure chamber to the tank.

11 Claims, 3 Drawing Sheets

HYDRAULIC CONTROL DEVICE FOR A MOBILE MACHINE, ESPECIALLY FOR A WHEEL LOADER

FIELD AND BACKGROUND OF THE INVENTION

The invention proceeds from a hydraulic control arrangement which is used for a mobile working machine, especially for a wheel loader.

It is known from DE 39 09 205 C1 to make use for the purpose of damping the pitching vibrations of wheel loaders which occur, especially, with a full loading shovel and at a high driving speed of a damping system which is a component of the hydraulic control arrangement of the wheel loader. For the purpose of vibration damping, the generally two hydraulic lifting cylinders for raising and lowering the loading shovels can be connected via a shutoff valve to a hydraulic accumulator which can be charged by a hydraulic pump via a filling line which branches off from the pump line upstream of the directional control valve block. The shutoff valve, which is arranged between the hydraulic accumulator and the lifting cylinders, is closed as long as the loading shovel is working, and can be opened by the driver or automatically as soon as pitching vibrations occur during driving, or as soon as the driving speed is above a specific value, for example above 6 km/h.

As a consequence of the fact that the filling line branches off upstream of the directional valve control block, the hydraulic accumulator is charged not only upon actuation of the directional control valve assigned to the lifting cylinders, but upon actuation of any directional control valve which leads to a buildup of pressure in the pump line. For example, the actuation of a steering valve belonging to a hydraulic steering system of the working machine can also lead to an inflow of pressure fluid to the hydraulic accumulator. If the shutoff valve is then also open, an uncontrolled movement of the lifting cylinders can take place.

Another damping system against pitching vibrations, which is likewise part of the hydraulic control arrangement of a working machine, is known from DE 41 29 509 C2. In this case, the filling line branches off from a working line which runs between the lifting cylinders and the directional control valve assigned thereto. The shutoff valve arranged in the filling line is pressure-controlled and can be opened by the load pressure, prevailing in the working line, of the lifting cylinders against the accumulator pressure, which can be applied to a rear control chamber on the valve element of the shutoff valve, and against the force of a weak compression spring. The accumulator pressure is thus in each case only slightly lower than the highest load pressure of the lifting cylinders which occurs during a working cycle. In order to damp the pitching vibrations, the rear control chamber of the shutoff valve is unloaded via a pilot valve to the tank, with the result that the shutoff valve can be opened and pressure fluid can be pushed back and forth freely between the hydraulic accumulator and the lifting cylinders.

It is also known, in a hydraulic control arrangement with a hydraulic cylinder and with a directional control valve by means of which the pressure-fluid channels between a pressure chamber of the hydraulic cylinder, a pressure-fluid source and a tank can be controlled, to provide a pilot-operated check valve by means of which the pressure chamber is blocked off in a largely leak-free fashion when the directional control valve is in its neutral position. When pressure fluid flows to the pressure chamber, the check valve opens in its direction of flow. To allow pressure fluid to flow out of the pressure chamber, it must be released, and this can be accomplished by a second working line leading to a second pressure chamber of the hydraulic cylinder.

A line-rupture protection valve, which is generally seated directly on the hydraulic cylinder, can also be connected upstream of a pressure chamber of a hydraulic cylinder. A line-rupture protection valve is configured in such a way that pressure fluid can flow readily to the pressure chamber via a check valve opening toward the pressure chamber. To allow pressure fluid to flow out of the pressure chamber, a bypass to the check valve is opened to a greater or lesser extent. As disclosed, for example, in DE 32 39 930 C2, a control piston is adjusted in a proportional manner for this purpose. In the case of the line-rupture protection valve in the above-mentioned publication, it can for this purpose have applied to it the same precontrol pressure with which the directional control valve is actuated in one of its directions of motion.

SUMMARY OF THE INVENTION

It is the object of the invention further to develop a hydraulic control arrangement having the features from the precharacterizing clause of claim 1 in such a way that the pressure chamber of a hydraulic cylinder can be blocked off but that the connection, required for damping pitching vibrations, to a hydraulic accumulator can nevertheless be established.

This object is achieved, in accordance with the invention wherein there is a pilot-operated check value which is connected upstream of the pressure chamber of the hydraulic cylinder and opens toward it and can be controlled to open when the directional control valve is actuated to allow pressure fluid to flow off from the pressure chamber to the tank and when the control valve is actuated to establish a fluid connection between the pressure chamber and the hydraulic accumulator. In this way, the pressure chamber at the hydraulic cylinder and the hydraulic accumulator can be connected to one another even if a branch line leading to the hydraulic accumulator and located between the directional control valve and the check valve is connected to a working line leading from the directional control valve to the hydraulic cylinder, thus allowing the check valve to perform its blocking function even as regards this branch line. The term pilot-operated check valve is taken, very generally, to include a bypassable check valve such as that present, for example, in the case of line-rupture protection valves.

According to a feature of the invention there are three control lines, the third control line, to which release means for the shutoff valve are connected, being connected to a first control line via switch-over means when the directional control valve is actuated and being connected to a second control line when the control valve is actuated. In principle, electrical control lines, electrical control signals and electrical switch-over means are also conceivable here.

Very often, however, the shutoff valve is hydraulically releasable. An advantageous refinement concerns a hydraulically releasable shutoff valve.

If the directional control valve is hydraulically actuable, there is a precontrol oil circuit with a precontrol oil source from which the control oil for releasing the shutoff valve is also expediently taken. For the hydraulic actuation of the directional control valve, use is generally made of precontrol valves which operate on the basis of pressure-reducing valves and which have an inflow port, an outflow port and an outlet connected to a control chamber at the directional control valve. A constant maximum precontrol pressure is present in the inflow port. A pressure lower than the maximum precontrol pressure is set in the outlet depending on the adjustment of a pressure-reducing valve, and this pressure is applied to the directional control valve. The directional control valve is adjusted proportionally to different extents depending on the level of the pressure at the outlet of a pressure-reducing valve. It is expedient if the second control line is connected to that part of the precontrol oil circuit in which the maximum precontrol pressure prevails.

A precontrol oil circuit is not necessary if the control chamber of the shutoff valve can be connected to the hydraulic accumulator via the second control line. In operation, the hydraulic accumulator is namely charged up to the load pressure, and especially is always charged up to the highest load pressure which has occurred in the pressure chamber of the hydraulic cylinder until a maximum pressure is achieved, thus ensuring that, when the control chamber of the shutoff valve is connected to the hydraulic accumulator, a sufficient pressure to open the shutoff valve is available.

To make very certain that no opening pressure builds up in the control chamber of the shutoff valve when the directional control valve is unactuated and the control valve is unactuated, a switch-over valve is provided via which, in a first control position which it assumes when the control valve is unactuated, the second control line is connected to the tank. It is then possible to use a simple hydraulic shuttle valve as a switch-over valve to connect the third control line to the first control line or the second control line so as to select maximum pressure.

BRIEF DESCRIPTION OF THE DRAWINGS

A number of illustrative embodiments of a hydraulic control arrangement according to the invention are shown in the drawings. The figures of the invention will now be explained in greater detail using these illustrative embodiments.

In the drawings.

DETAILED DESCRIPTION OF THE PREFERRED EMBODIMENT

Figure 1:
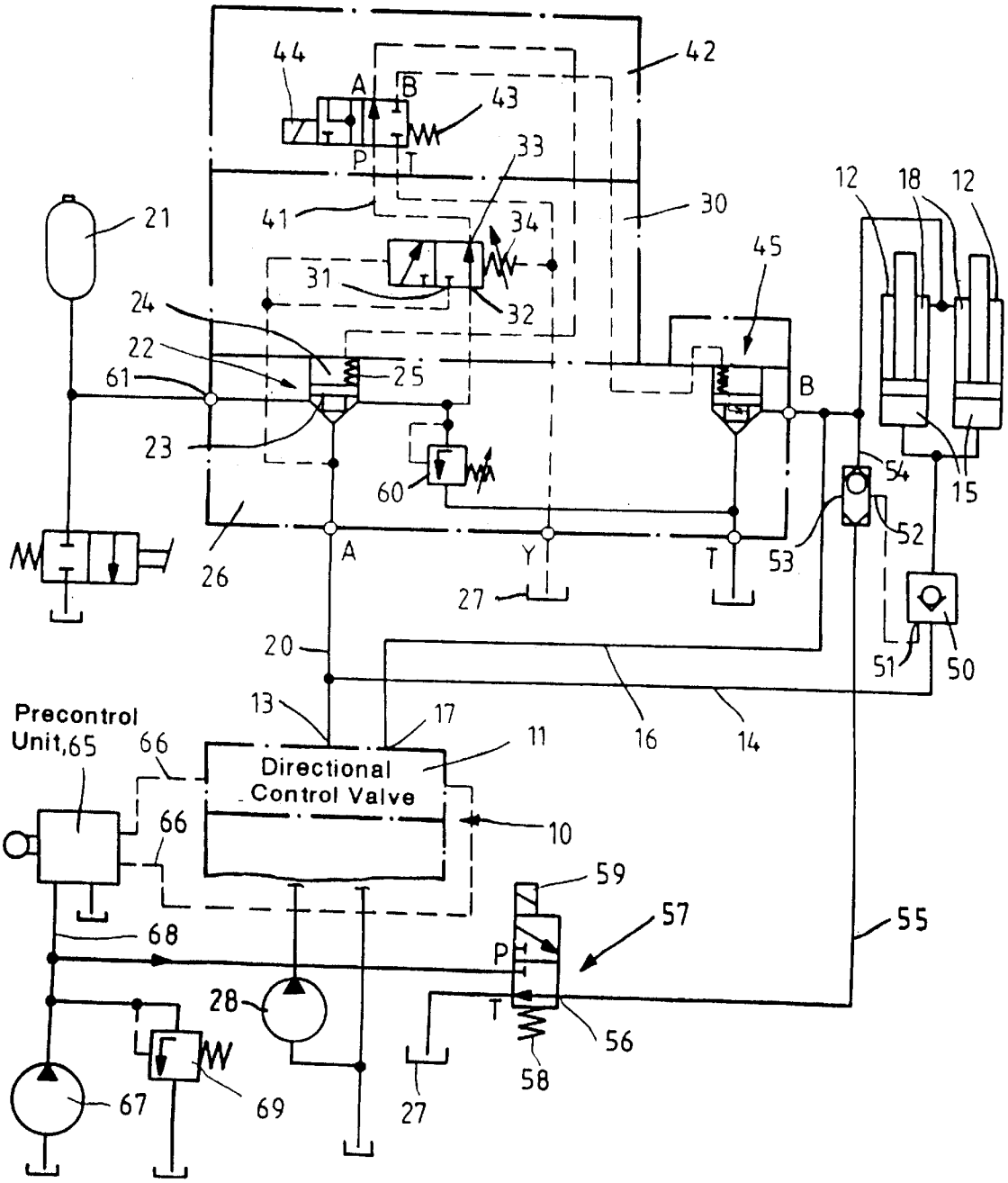
FIG. 1 shows the first illustrative embodiment, in which a control chamber of a pilot-operated check valve can be subjected to pressure from the precontrol circuit for actuating the directional control valve via a switch-over valve and a shuttle valve.

The hydraulic control arrangements shown are provided in each case for wheel loaders, tractors, telescopic handling equipment or other machines, and comprise a control block 10 with a plurality of directional control valves, especially also with a directional control valve 11 which can assume a spring-centered mid-position, and with the aid of which it is possible to drive two hydraulic cylinders 12 which are constructed as differential cylinders and with the aid of which the boom of a wheel loader, for example, can be raised and lowered. The directional control valve 11 has a first working port 13 from which a first working line 14 leads to the base-side pressure chambers 15 of the hydraulic cylinders 12. A second working line 16 runs between a second working port 17 of the directional control valve 11 and the pressure chambers 18, on the piston-rod side, of the hydraulic cylinders 12. The two working ports 13 and 17 can be connected to a source of pressure fluid and to a tank 27 via a pressure port and a tank port.

Branching off from the working line 14 is a filling line 20, which leads via a shutoff valve 22 to a hydraulic accumulator 21. The shutoff valve 22 is constructed as a 2-way cartridge valve and has a movable valve element 23. The latter is a differential piston which can be seated on a seating cone with the end face of the piston section of smaller diameter, in the manner of a seated valve. The pressure prevailing in the working line 14, that is to say the load pressure of the two hydraulic cylinders 12, is applied in the opening direction to the valve element 23 at said end face. The accumulator pressure acts in the opening direction at the annular surface between the two piston sections of the valve element 23 via a port 61 of a plate 26 in which the valve element 23 is located. A pressure prevailing in a rear control chamber 24 and a compression spring 25, this pressure being equivalent to a pressure of about 3 to 4 bar, are applied to the valve element 23 in the closing direction.

Two further valves are constructed on the plate 26 with the 2-way cartridge valve 22. The first valve 30 is a 3/2-way valve with a first inlet 31, which is connected to the section of the filling line 20 located between the working line 14 and the shutoff valve 22, and with a second inlet 32, which is connected to the hydraulic accumulator 21. An outlet 33 of the directional control valve 30 can be connected either to the inlet 31 or to the inlet 32, depending on the load pressure in the working line 14. To be specific, a settable compression spring 34 acts on the valve element (not represented in more detail) of the valve 30 in order to connect the outlet 33 to the inlet 32. The pressure in the inlet 31, that is to say the load pressure of the hydraulic cylinders 12, is applied to the valve element in order to connect the outlet 33 to the inlet 31. From the outlet 33 of the directional control valve 30, a control channel 41 leads to a port P of a control valve 42, which is a 4/2-way valve. Under the action of a compression spring 43, the valve element of said 4/2-way valve assumes a neutral position in which there is a passage between the port P and a port A which is connected to the control chamber 24 of the shutoff valve 22. A tank port T and a further port B of the control valve 42 are blocked off in the neutral position of the latter. The tank port is connected to a leak port Y of the plate 26 via channels leading through the housings of the various valves. The port B of the control valve 42 is connected to the rear control chamber of a second 2-way cartridge valve 45, which is located in the plate 26 and via which the pressure chambers 18, on the side of the piston rods, of the hydraulic cylinders 12 can be connected to a tank port T of the plate 26. The valve element of the control valve 42 can be brought by an electromagnet 44 into a control position in which the port P is blocked off and the two ports A and B are connected to the port T.

Figure 2:
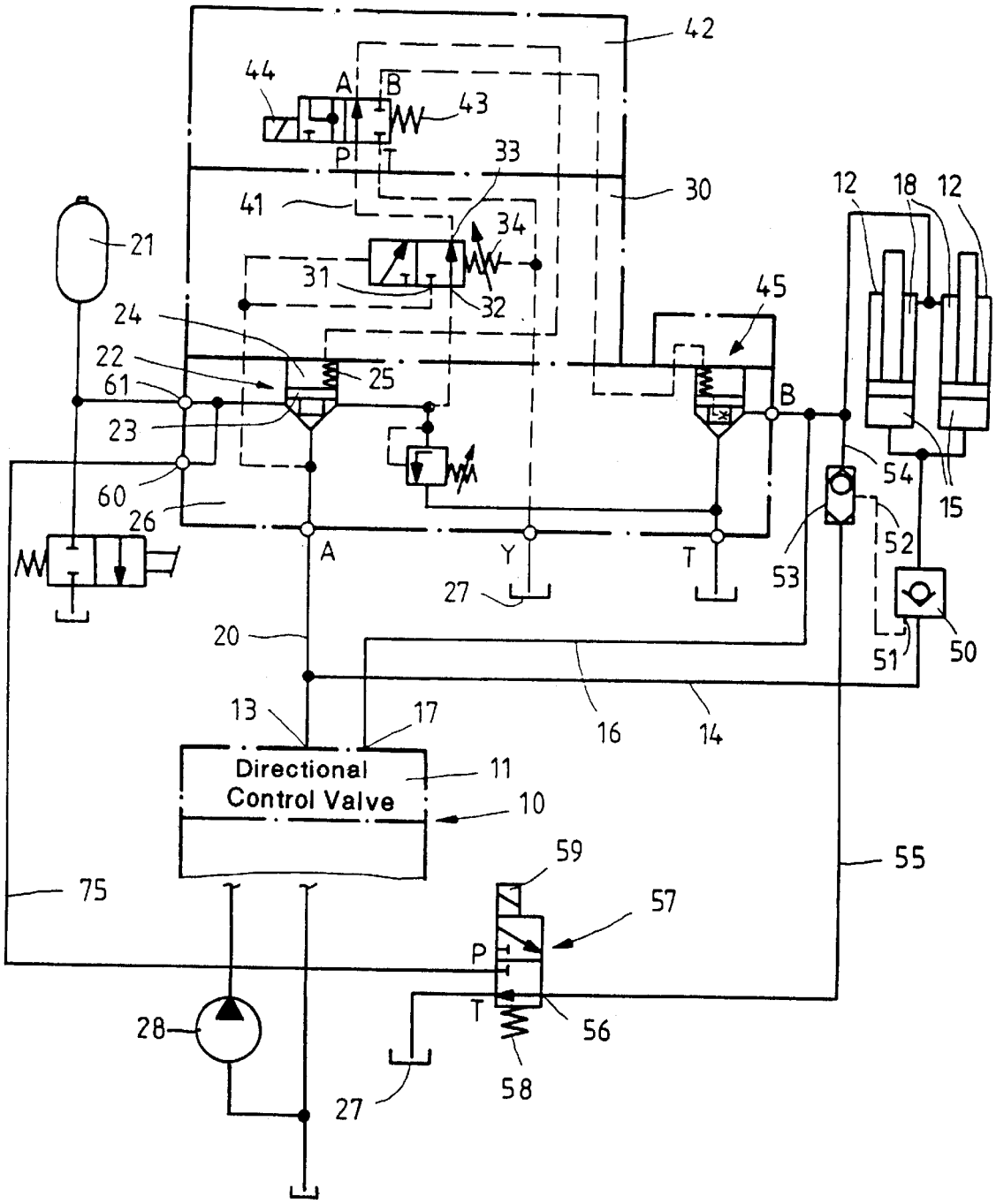
FIG. 2 shows the second embodiment, in which the control chamber at the check valve is subjected to pressure from the hydraulic accumulator

To ensure that the base-side pressure chambers 15 of the hydraulic cylinders 12 are blocked off in a leak-free fashion in the neutral position of the directional control valve 11, a pilot-controlled check valve 50 located in the working line 14 and opening toward the pressure chambers is arranged upstream of these pressure chambers. The check valve 50 can be released hydraulically. For this purpose, a control valve 52, which, in the embodiments shown in FIGS. 1 and 2, is connected to the outlet of a shuttle valve 53, is connected to a control chamber 51. The control line 52 is the third control line in the sense of the patent claims. Extending between one inlet of the shuttle valve 53 and the working line 16, which leads to the piston-rod-side pressure chambers 18 of the hydraulic cylinders 12, is a control line 54, which is the first control line in the sense of the patent claims. In the embodiments shown in FIGS. 1 and 2, another control line 55, the second control line in the sense of the patent claims, runs between the second inlet of the shuttle valve 53 and a port 56 of a 3/2-way valve 57, the movable valve element of which assumes a neutral position, in which the port 56 is connected to a tank port T, under the action of a compression spring 58 and can be moved by an electromagnet 59 into a position in which the port 56 is connected to a pressure port P.

In the embodiment shown in FIG. 1, the directional control valve 11 of the control block 10 can be actuated hydraulically in a proportional fashion, the precontrol pressures being produced with the aid of a hydraulic precontrol unit 65 and transmitted to the directional control valve 11 via control lines 66. Control oil is supplied by a control-oil pump 67, from which a delivery line 68 leads to the precontrol unit 65. A relief valve 69 is used to maintain a pressure of, for example, 30 bar in the delivery line 68. This is the maximum precontrol pressure which can be applied to the directional control valve 11. The pressure port P of the switch-over valve 57 is connected to the delivery line 68.

If the piston rods of the hydraulic cylinders 12 are to be extended, the directional control valve is actuated in a direction such that pressure fluid can flow to the working line 14 from a hydraulic pump (pressure medium source) 28. The check valve 50 opens and the piston rods extend, a load pressure determined by the load moved by the hydraulic cylinders prevailing in the pressure chambers 15 of the hydraulic cylinders 12 and in the working line 14. As long as the load pressure in the working line 14 remains below the pressure set at the compression spring 34 of the directional control valve 30, the latter switches the accumulator pressure through to the rear control chamber 34 of the shutoff valve 22 via the control valve 42. The load pressure opens the shutoff valve 22 whenever it is above the accumulator pressure by at least the small pressure difference equivalent to the force of the compression spring 25. Pressure fluid can then pass into the hydraulic accumulator 21 via the filling line 20, with the result that, neglecting the force of the weak compression spring 25, said hydraulic accumulator is always charged up to the highest load pressure occurring in the working line 14 during a working cycle. At the same time, account should be taken of the fact that the check valve 50 can also be fitted with a closing spring. The pressure in the section of the working line 14 between the directional control valve II and the check valve is then higher than the pressure in the pressure chambers 15 of the hydraulic cylinders 12 by a small pressure difference equivalent to the force of this closing spring. If the equivalent pressure differences of the closing spring and of the compression spring 25 of the valve 22 are made equal, the pressure in the hydraulic accumulator 21 is equal to the highest pressure that has occurred in the pressure chambers 15. If the load pressure at the valve 30 is able to overcome the force of the compression spring 34, the shutoff valve 22 remains closed. This is because, after the valve 30 is switched over, the load pressure is present in the rear control chamber 24 of the shutoff valve 22, with the result that, in combination with the compression spring 25, the shutoff valve 22 is reliably held closed. The pressure in the hydraulic accumulator 21 can therefore not exceed the value set at the compression spring 34 of the valve 30. However, for safety reasons a relief valve 60 is also provided and its inlet is connected to the hydraulic accumulator 21.

The pressure prevailing in the working line 16 and in the piston-rod-side pressure chambers 18 of the hydraulic cylinders 12 during the extension of the piston rods is close to the tank pressure.

Let it be assumed that the loading shovel of a wheel loader is loaded and that the wheel loader is being driven to an unloading site. The electromagnet 44 of the control valve 42 and the electromagnet 59 of the switch-over valve 57 are energized arbitrarily by the vehicle driver when pitching vibrations occur, or automatically at a specific speed of the mobile working machine, e.g. at a speed of 6 km/h, with the result that these two valves switch over from the neutral positions shown in FIG. 1 into the other control position respectively. The rear control chamber 24 of the shutoff valve 22 is now connected via the control valve 42 to the port Y of the plate 26, and thus relieved to the tank 27.

The valve element 23 of the shutoff valve 22 is raised from its seat by the accumulator pressure and by the pressure in the working line 14. The control line 55 is connected via the switch-over valve 57 to the delivery line 68, with the result that a pressure equal to the maximum precontrol pressure is applied to one inlet of the shuttle valve 53. Since the pressure prevailing at the other inlet of the shuttle valve 53 is the tank pressure, this pressure is transmitted by the shuttle valve to the control line 52 and, from there, into the control chamber 51 of the pilot-controlled check valve 50. This valve opens, giving an open connection between the hydraulic accumulator 21 and the pressure chambers 15 of the hydraulic cylinders 12. Since the accumulator pressure corresponds to the maximum pressure reached during the working cycle, upon opening of the valve 22 or 50 last opened no sagging of the piston rods of the hydraulic cylinders 12 occurs, but, at most, the load shovel rises slightly. It may well be that load pressures occur during the working cycle which cause the valve 30 to switch, and which therefore are not followed by the loading state of the hydraulic accumulator. However, these load pressures occur only in special situations, for example when an object anchored in the ground tears free, or when the loading shovel is driven against a stop, but are not caused by the weight of the loading shovel and the loaded material, which acts solely when the wheel loader is being driven. The loading state of the hydraulic accumulator 21 is therefore always sufficient to keep the loading shovel at the level which the latter assumes upon opening of valve 22 or valve 50.

Pressure fluid can be displaced from the pressure chambers 18, on the side of the piston rod, of the hydraulic cylinders 12 into the tank via the valve 45, which is likewise opened by the switching over of the control valve 42. Replacement fluid can be drawn in via replenishing valves assigned to the directional control valve 11. This allows compensation of volumetric changes in the pressure chambers 18 which occur during the open connection of the pressure chambers 15 to the hydraulic accumulator 21.

The formation according to FIG. 2 is largely identical to that according to FIG. 1 and therefore only the differences are explored in the following text, attention otherwise being drawn to the description of the design according to FIG. 1. A hydraulic line 75 now runs between the pressure port P of the switch-over valve 57 and a port 60 of the plate 26, this port being connected internally to a second port 61 located in the connection between the shutoff valve and the hydraulic accumulator 21. The accumulator pressure is thus present at the pressure port P of the switch-over valve 57. Since, during the working cycle, the hydraulic accumulator is always charged up to the highest load pressure which has occurred in the pressure chambers 15 of the hydraulic cylinders 12, with the proviso already mentioned, the accumulator pressure is available to release the check valve 50 upon arbitrary or automatic actuation of the switch-over valve 57, which takes place together with the actuation of the control valve 42. As in the case of the design according to FIG. 1, the directional control valves of the control block 10 can be hydraulically actuable. However, electric or mechanical actuation is also readily possible. A precontrol oil circuit is not necessary.

Figure 3:
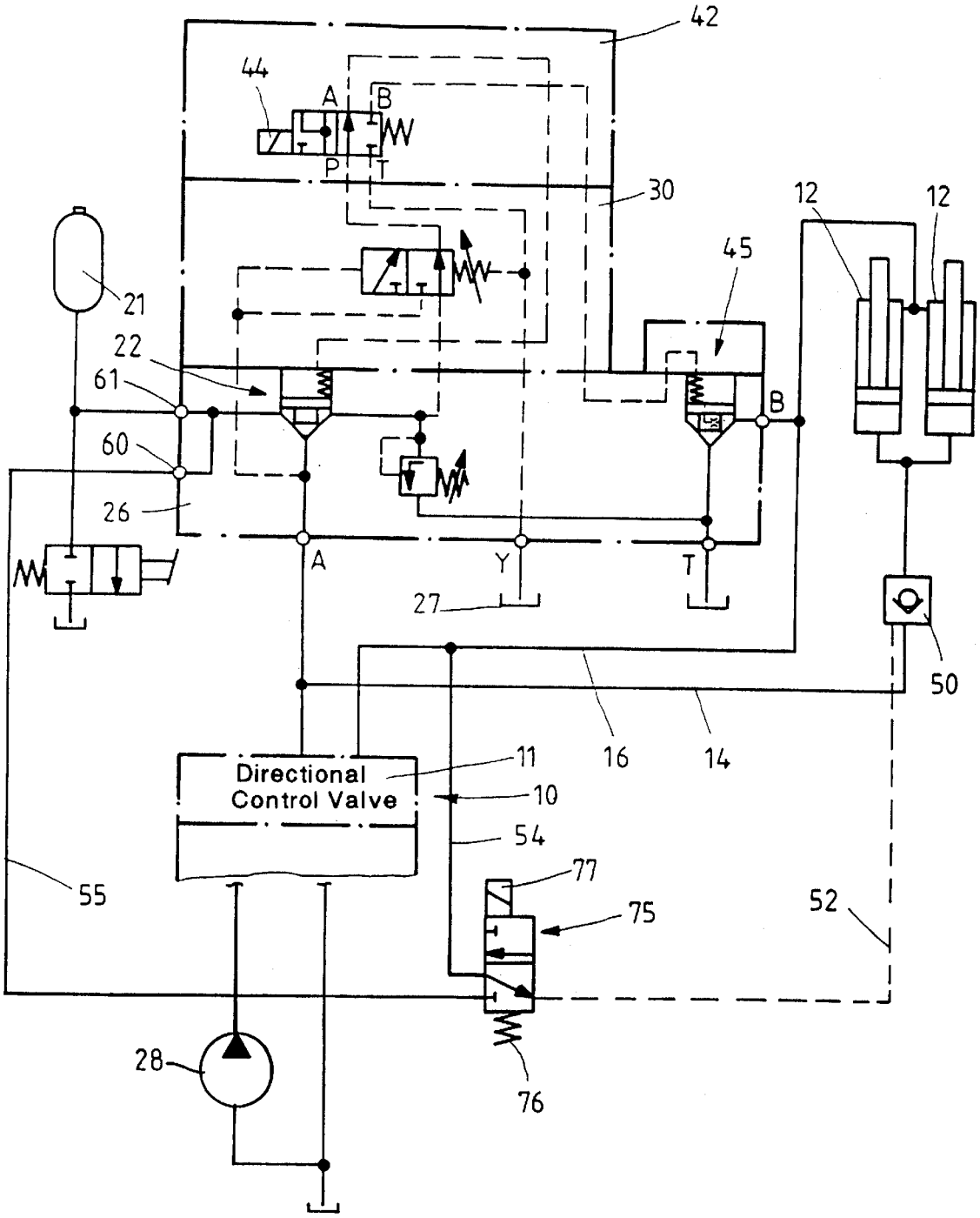
FIG. 3 shows the third embodiment, in which a first control line or a second control line can be connected by means of an electrically actuable switch-over valve to a third control line leading to the control chamber of the pilot-operated check valve.

The formation according to FIG. 3 likewise coincides with regard to the control block 10, the hydraulic cylinders 12, the hydraulic accumulator 21, the valves 22, 30, 42, 45 and 50 with the designs according to FIGS. 1 and 2. There is a further point of correspondence with the design according to FIG. 2 in that, for release, the check valve 50 is subjected to pressure from the hydraulic accumulator 21. However, the shuttle valve 53 shown in FIG. 2 is now replaced by a switch-over valve 75 which, under the action of a compression spring 76, assumes a neutral position in which the third control line 52 is connected to the first control line 54. The valve 75 can be moved into a second control position by an electromagnet 77, which is activated simultaneously with the electromagnet 44 of the control valve 42, in which position the third control line 52 is connected to the second control line 55, which leads directly to the port 60 of the plate 26. Relief of the control line 55 to the tank is thus not envisaged in the case of the design according to FIG. 3, but it could be made possible in this case as well, by means of another switch-over valve for example.

We claim:

1. A hydraulic control arrangement for a mobile working machine, comprising at least one hydraulic cylinder (12) with aid of which a working tool can be moved, a directional control valve (11) for controlling the pressure-fluid channels between a pressure chamber (15) of the hydraulic cylinder (12), a pressure-fluid source and a tank (27), a hydraulic accumulator (21) which is connectable to the pressure-fluid source via a filling line (20), and a control valve (42) with aid of which a connection between the hydraulic accumulator (21) and the pressure chamber (15) of the hydraulic cylinder (12) can be controlled to open and close, a pilot-operated shutoff valve (50) which is connected upstream of the pressure chamber (15) and opens toward it, wherein the pilot-operated shutoff valve (50) is arranged between the directional control valve (11) and the pressure chamber (15) of the hydraulic cylinder (12) and is controllable to open when the directional control valve (11) is actuated to allow pressure fluid to flow off from the pressure chamber (15) to the tank (27) and when the control valve (42) is actuated to establish a fluid connection between the pressure chamber (15) and the hydraulic accumulator (21).

2. A hydraulic control arrangement for a mobile working machine, comprising at least one hydraulic cylinder (12) with aid of which a working tool is movable, a directional control valve (11) for controlling the pressure-fluid channels between a pressure chamber (15) of the hydraulic cylinder (12), a pressure-fluid source and a tank (27), a hydraulic accumulator (21) which is connectable to the pressure-fluid source via a filling line (20), and a control valve (42) with aid of which a connection between the hydraulic accumulator (21) and the pressure chamber (15) of the hydraulic cylinder (12) is controlable to open and close, a pilot-operated shutoff valve (50) which is connected upstream of the pressure chamber (15) and opens toward it and is controllable to open when the directional control valve (11) is actuated to allow pressure fluid to flow off from the pressure chamber (15) to the tank (27) and when the control valve (42) is actuated to establish a fluid connection between the pressure chamber (15) and the hydraulic accumulator (21), wherein, when the directional control valve (11) is actuated, the shutoff valve (50) is supplyable with a control signal via a first control line (54) and, when the control valve (42) is actuated, is supplyable with a control signal via a second control line (55), and wherein there are switch-over means (53, 75) which, as a function of the actuation of the control valve (42), connect a third control line (52) running therebetween and the release means (51) of the shutoff valve (50) of the first control line (54) or the second control line (55).

3. The hydraulic control arrangement as claimed in claim 2, wherein the shutoff valve(SO) is hydraulically releasable and has a control chamber (51) to which the hydraulic third control line (52) leads, there is a switch-over valve (53, 75) which can be actuated by means of the control valve (42), and the third control line (52) is connected to the hydraulic first control line (54) in one control position of the switch-over valve (53, 75) and when the directional control valve (11) is actuated to allow pressure fluid to flow off from the pressure chamber (15) of the hydraulic cylinder (12), and is connected to the hydraulic second control line (55) in the other control position of the switch-over valve (53, 75).

4. The hydraulic control arrangement as claimed in claim 3, wherein the first control line (54) is connected to a second pressure chamber (18) of the hydraulic cylinder (12).

5. The hydraulic control arrangement as claimed in claim 3, wherein the directional control valve can be actuated hydraulically by applying a precontrol pressure thereto and the precontrol pressure is also present in the first control line.

6. The hydraulic control arrangement as claimed in claim 3, wherein there is a precontrol oil circuit with a precontrol-oil source (67) and the directional control valve (11) can be actuated hydraulically by the inflow of precontrol oil from the precontrol-oil circuit, and the shutoff valve (50) can be released by inflow of precontrol oil from the precontrol-oil circuit via the second control line (55).

7. The hydraulic control arrangement as claimed in claim 6, wherein there is a switch-over valve (57), and the second control line (55) is connected to the tank (27) in a first control position of the switch-over valve (57) and to a pressure-fluid source (21, 67) in a second control position of the switch-over valve (57).

8. The hydraulic control arrangement as claimed in claim 7, further comprising a shuttle valve (53) which acts in such a way as to select the maximum of the pressures in the first control line (54) and the second control line (55) and in each case connects that line of these two control lines (54, 55) in which the higher pressure occurs to the third control line (52).

9. The hydraulic control arrangement as claimed in claim 3, wherein the control chamber (51) of the shutoff valve (50) can be connected to the hydraulic accumulator (21) via the second control line (55).

10. The hydraulic control arrangement as claimed in claim 7, wherein there is a switch-over valve (57), and the second control line (55) is connected to the tank (27) in a first control position of the switch-over valve (57) and to a pressure-fluid source (21, 67) in a second control position of the switch-over valve (57).

11. The hydraulic control arrangement as claimed in claim 10, further comprising a shuttle valve (53) which acts in such a way as to select the maximum of the pressures in the first control line (54) and the second control line (55) and in each case connects that line of these two control lines (54, 55) in which the higher pressure occurs to the third control line (52).

* * * * *